United States Patent [19]

Wunder

[11] Patent Number: 4,718,566

[45] Date of Patent: Jan. 12, 1988

[54] INSULATED CARAFE

[75] Inventor: Dieter Wunder, Reichelsheim, Fed. Rep. of Germany

[73] Assignee: Braun Aktiengesellschaft, Kronberg, Fed. Rep. of Germany

[21] Appl. No.: 948,107

[22] Filed: Dec. 31, 1986

Related U.S. Application Data

[63] Continuation of Ser. No. 768,032, Aug. 21, 1985, abandoned.

[30] Foreign Application Priority Data

Sep. 19, 1984 [DE] Fed. Rep. of Germany ..... 3434331

[51] Int. Cl.[4] ..... A47J 41/00

[52] U.S. Cl. ..... 215/13.1; 215/100 A; 215/12.1; 220/421; 220/425; 222/183; 222/465.1

[58] Field of Search ..... 215/12 R, 12 A, 13 R, 215/13 A, 100 A; 222/183, 465.1; 220/420, 421, 425

[56] References Cited

U.S. PATENT DOCUMENTS

| | | | |
|---|---|---|---|
| 8658 | 4/1879 | Norris | 222/183 |
| 1,712,228 | 5/1929 | Payson et al. | 215/12 R |
| 1,935,969 | 11/1933 | Witherspoon | 222/183 |
| 2,328,338 | 8/1943 | Hauptman | 215/12 R |
| 2,805,561 | 9/1957 | Emmert et al. | 215/12 R X |
| 2,837,232 | 6/1958 | Rossi | 215/13 R |
| 2,895,636 | 7/1959 | Martin | 215/13 R |
| 2,954,888 | 10/1960 | Bramming | 215/13 R |
| 3,115,263 | 12/1963 | Leslie-Smith | 215/13 R |
| 3,145,708 | 8/1964 | Fischer | 215/12 R X |
| 3,221,915 | 12/1965 | Gort et al. | 215/13 R |
| 3,258,147 | 6/1966 | Rownd | 215/13 R |
| 3,476,277 | 11/1969 | Rownd | 215/13 R |
| 3,638,820 | 2/1972 | Misu | 215/13 A |
| 3,813,757 | 6/1974 | Bell | 215/13 R X |
| 3,871,543 | 3/1975 | Chadfield et al. | 215/13 R |

FOREIGN PATENT DOCUMENTS

| | | | |
|---|---|---|---|
| 1679148 | 4/1971 | Fed. Rep. of Germany . | |
| 2658295 | 7/1978 | Fed. Rep. of Germany . | |
| 2952557 | 7/1981 | Fed. Rep. of Germany . | |
| 8112201 | 7/1981 | Fed. Rep. of Germany . | |
| 3045896 | 6/1982 | Fed. Rep. of Germany . | |
| 3347481 | 8/1984 | Fed. Rep. of Germany | 215/12 A |
| 2474851 | 2/1980 | France . | |
| 466676 | 6/1937 | United Kingdom | 222/183 |

*Primary Examiner*—William Price
*Assistant Examiner*—Sue A. Weaver

[57] ABSTRACT

The proposed insulated carafe consists of an inner container, especially one made of glass,and a plastic jacket, with a seal between the inner container and the plastic jacket being provided exclusively by an elastic positive fit between the parts mentioned.

20 Claims, 1 Drawing Figure

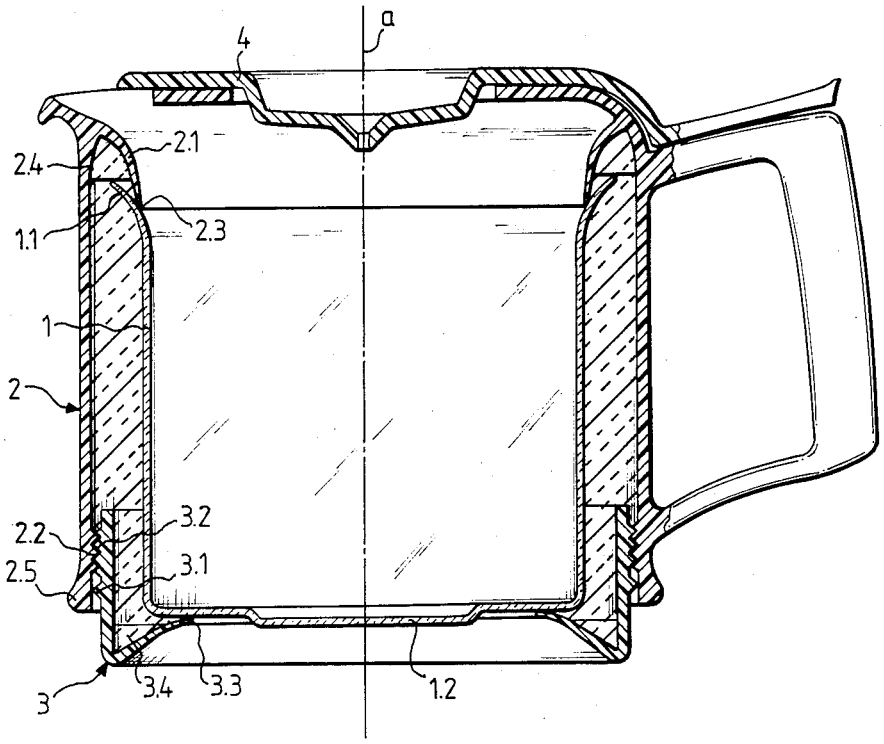
a
4
2.1
2.4
2.3
1.1
1
2
3.2
2.2
3.1
2.5
3
3.4
3.3
1.2

INSULATED CARAFE

This is a continuation of application Ser. No. 768,032, filed Aug. 21, 1985, now abandoned.

The invention relates to an insulated carafe, especially suitable for storing hot beverages and composed of an inner container to hold the hot liquid and a heat-insulating jacket surrounding it.

A plurality of insulated carafes is known wherein the inner container itself is made heat-insulating in the form of a double-walled so-called Dewar vessel, surrounded by an impact-resistant jacket to provide mechanical protection (see for example German Utility Model No. 81 12 201 and German AS No. 26 58 295). Insulated carafes are also known which consist of a glass inner container, an insulating layer surrounding it, made of plastic foam for example, as well as an outer jacket, made for example from metal (see for example German Pat. No. 30 45, 896). In addition, a coffee carafe is shown in another connection in German OS No. 29 52 557, consisting of a glass inner container and a protective jacket surrounding it, said jacket being assembled from two parts and not providing insulation.

In all of these insulated carafes, which comprise a glass inner container and a jacket surrounding it, there is a problem of reliable and permanent sealing between the glass vessel and the jacket; for manufacturing reasons, the glass inner containers used can be manufactured only with relatively large dimensional tolerances, so that the jackets must be structurally designed to compensate for the glass tolerances. Since in general it is required that liquids not be able to penetrate the space between the glass container and the jacket, where they would lead to permanent contamination, compressible sealing rings are usually inserted at the junctions of the carafe parts, said rings also compensating for the dimensional tolerances. Heretofore, no solutions have been proposed which ensure a reliable seal between the glass inner container and the jacket while avoiding such additional tolerance-compensating sealing means.

Since the sealing rings used in this connection, which existing regulations require be made of physiologically harmless materials, imposing a not insignificant burden on the manufacturing costs of such carafes not only as regards material costs but also as regards assembly expense, the goal has long existed of finding a design solution for such carafes which would render the use of such sealing rings superfluous.

According to the invention, this goal is achieved in an insulating carafe of the species recited hereinabove, comprising a glass inner container, an insulating layer, and an outer shell surrounding the latter made of elastic plastic material, by virtue of the fact that the upper part of the outer shell comprises a circumferential collar that fits over the edge of the glass inner container, the inner edge of said collar abutting the inside of the glass container edge in a sealing manner all the way around without any additional sealing means with elastic pretensioning. It has been found that the elastic pretensioning of the inner edge of the collar produced by elastic deformation of the above-mentioned collar edge ensures the required seal. Because of the elastic deformability of the collar and its inner edge, dimensional variations in the glass containing amounting to several millimeters in both the radial and axial directions can readily be compensated. The reliability of the seal can be even further increased according to the invention by virtue of the fact that the inside edge of the collar comprises a sealing labyrinth made of circumferential sealing lips.

In a preferred embodiment of the invention, the glass container has an upper marginal area which expands radially, against which the inner edge of the collar of the plastic outer shell abuts in a sealing manner under radial and/or axial elastic pretension. In order to influence the rigidity of the collar and consequently its deformability which is important for the sealing action, and to be able to adapt to the conditions of the overall design, it is proposed in another embodiment of the invention to form radial ribs in the angle enclosed by the side wall of the upper part of the outer shell and the collar, said ribs gradually stiffening the collar as required.

Preferably, the upper part of the outer shell is so designed that its lower edge fits over and overlaps the upper edge of the bottom part, said bottom part having a circumferential radial projection which abuts the inner surface of the upper part in sealing fashion all the way around under radial pressure. The radial press fit thus achieved provides a permanent secure seal between the two parts of the outer shell, an approximately triangular cross-sectional shape with the apex directed outward having shown itself to be especially suitable for said circumferential radial projection. In addition, it has been found advantageous to design the upper part in the abutting area of the radial projection to be reinforced, which can be accomplished in particular by an increased wall thickness in this area by comparison to the remainder of the side wall.

Preferably, the upper and lower parts of the outer shell are provided with interlocking locking means in the area which lies above the sealing radial projection after they are fitted together, said locking means being disposed on the inside wall of the upper part and the outside wall of the bottom part. These locking means are preferably designed as corresponding undercuts which interlock with pretensioning acting parallel to the central axis of the carafe, said undercuts in various advantageous embodiments having the form of an internal and external thread or radial pins and recesses corresponding thereto, or even a bayonet lock.

In an embodiment of the invention which can be used advantageously in coffeemakers with warming plates, the bottom of the outer shell is designed in the form of a ring that exposes the entire middle part of the bottom of the glass container with an inner edge which is directed inward, designed in the form of a circumferential sealing lip, and abutting the marginal area of the glass container bottom in sealing fashion all the way around under pretension which acts parallel to the central axis of the carafe. The middle part of the bottom of the glass container thus exposed can therefore be brought into direct thermal contact with the warming plate of the coffeemaker. The proposed design for the inner edge of the bottom ring also ensures in this respect a secure seal to the glass inner container, with this design also contributing to compensation of height tolerances in the glass inner container. Advantageously, radial ribs can be formed in the angle between the side wall of the bottom part and the collar extending toward the inner edge, said ribs producing a deliberate stiffening of the collar, permitting flexible adaptation to special features of the overall design.

Although the space which surrounds the glass inner container and is surrounded on all sides in sealing fashion according to the invention by the outer shell already constitutes an effective heat-insulating layer, in preferred embodiments of the invention it is filled with insulating materials known of themselves, as for example (especially spherical) foamed plastic particles, or is preferably completely filled with fine-pored plastic foam by foaming to improve the thermal insulation.

The drawing presents a longitudinal sectional view of an insulated carafe in accordance with the invention.

As the lengthwise section shown through a coffee carafe of the species according to the invention suitable for use in coffeemakers with a warming plate shows, said carafe consists of an inner container 1 which is not heat-insulating and is preferably made of glass, surrounded by the outer shell composed of upper part 2 and bottom part 3. The upper part of the carafe is closable by a lid 4. A surrounding collar 2.1 is molded on upper part 2, said collar fitting around the edge 1.1 of container 1 and abutting the inside of container edge 2.1 with its inner edge 2.3 under elastic pretension, in a positively sealing manner all the way around. In the embodiment shown, the upper edge 1.1 of container 1 is designed inclined outward, so that inner edge 2.3 of collar 2.1 abuts it in a positively sealing manner under both radial and axial elastic pretension. In the angular space enclosed by the side wall of the upper part 2 of the outer shell and collar 2.1, reinforcing ribs 2.4 are formed, which influence the flexibility of collar 2.1 and also can serve as a stop for the upper edge of the container.

Bottom part 3 which is inserted from below into upper part 2 of the outer shell comprises a circumferential radial projection 3.1 with an approximately triangular cross section, which abuts the inside of reinforced edge 2.5 of the upper part in a positively sealing manner under radial pressure all the way around. The bottom part 3 of the outer shell, which is made annular and exposes container bottom 1.2, abuts the marginal area of container bottom 1.2 in a positively sealing fashion all the way around with its inner edge 3.3 which is designed as a sealing lip. Here again, reinforcing ribs 3.4 can be provided, by means of which the firmness of this support can be influenced.

Above radial projection 3.1 which provides the radial seal between upper part 2 and bottom part 3 of the outer shell, i.e. within the sealed intermediate space, an internal thread 2.2 is provided on the inside wall of upper part 2 and an external thread 3.2 can be seen on bottom part 3. The two parts of the outer shell are locked together by means of this thread, with collar 2.1 and inside edge 3.3 of bottom part 3 designed as a sealing lip receiving the pretensioning by elastic deformation which effects their positive pressure against one another.

It is also surprising to the individual skilled in the art that all three seals shown, i.e. inner edge 2.3 of the collar which abuts container edge 1.1, inner edge 3.3 of bottom part 3 which abuts the marginal area of container bottom 1.2, and the radial pressure produced by projection 3.1 function in the long term so reliably that, even with regular cleaning of such coffee carafes in dishwashers, no moisture whatever penetrates their heat-insulating spaces between their walls. It should also be mentioned in this connection that this result is accomplished without using any auxiliary means, such as elastic or plastic sealing rings or adhesives.

I claim:

1. Insulated carafe comprising an inner container having a cylindrical wall portion with an annular outwardly inclined upper edge surface and a transverse base portion, jacket structure housing said inner container, said jacket structure including a first member having a cylindrical body portion surrounding and spaced from the cylindrical wall portion of said inner container, an annular, continuous flexible flange adjacent the top of said first member and seated in positive sealing relation under radial and axial elastic pretension on said outwardly inclined upper edge surface of said inner container, and coupling structure adjacent the bottom of said cylindrical body portion, and a second member having a cylindrical body portion, an annular continuous flexible flange that has an upwardly directed inner edge that provides a circumferential sealing lip, said sealing lip abutting the marginal area of said transverse base portion of said inner container under pretension acting parallel to the central axis of said carafe in positive sealing relation under elastic pretension, and coupling structure in coupling engagement with the coupling structure of said first member, said first and second members having cooperating sealing surfaces adjacent said coupling structures in sealing engagement to provide a continuous seal between said first and second members, said inner container and said jacket structure cooperating to provide a sealed chamber surrounding a cylindrical body portion of said inner container.

2. The carafe of claim 1 and further including radial reinforcing ribs extending between said annular flexible flange and said cylindrical body portion of said first member.

3. The carafe of claim 1 wherein the lower edge of said first jacket member fits over the upper edge of said second jacket member in overlapping relation, and said cooperating sealing surface on one of said jacket members comprises a circumferential radial projection which abuts the cooperating sealing surface of the other said jacket member and provides a positive seal under radial pressure all the way around said jacket structure.

4. The carafe of claim 3 wherein said cooperating sealing surface is cylindrical and said circumferential radial projection has an approximately triangular cross-section with its apex abutting said cylindrical sealing surface.

5. The carafe of claim 4 wherein said first jacket member has reinforced structure in the area of said circumferential radial projection, said reinforced structure having a wall thickness greater than the remainder of the wall thickness of said cylindrical body portion.

6. The carafe of claim 1 wherein said cooperating coupling structures of said first and second jacket members are disposed on the sealed chamber side of said sealing surfaces.

7. The carafe of claim 1 wherein said coupling structures comprise internal thread structure on said first jacket member and cooperating external thread structure on said second jacket member, said thread structures subjecting said flexible flanges of said first and second jacket members to pretensioning in a direction parallel to the central axis of said carafe.

8. The carafe of claim 1 and further including radial reinforcing ribs formed between said body portion of said second jacket member and said annular flexible flange.

9. The carafe of claim 1 wherein said annular flange of said second jacket member supports said transverse base portion of said inner container spaced above the bottom of said second jacket member.

10. The carafe of claim 1 and further including thermal insulation material disposed in the sealed chamber between the cylindrical wall portion of said inner container and said cylindrical body portions of said jacket structure.

11. The carafe of claim 10 wherein said inner container is of glass of single wall thickness and said jacket structure is of plastics material.

12. The carafe of claim 11 wherein the lower edge of said first jacket member fits over the upper edge of said second jacket member in overlapping relation, and said annular sealing structure comprises a circumferential radial projection on one of said jacket members which abuts the cooperating sealing surface of the other said jacket member and provides a positive seal under radial pressure all the way around said jacket structure.

13. The carafe of claim 12 wherein said coupling structures comprise internal thread structure on said first jacket member and cooperating external thread structure on said second jacket member, said thread structures subjecting said flexible flanges of said first and second jacket members to pretensioning in a direction parallel to the central axis of said carafe.

14. The carafe of claim 13 wherein said annular flange of said second jacket member supports said transverse base portion of said glass container spaced above the bottom of said second jacket member with the middle part of the base of the glass container exposed so that it can be brought into direct thermal contact with the warming plate of a coffee maker.

15. The carafe of claim 1 wherein said inner container is of a single wall thickness glass, said jacket structure is of plastics material, said annular flange of said second jacket member supports said transverse base of said inner container spaced above the bottom of said second jacket member with the middle part of the base of the inner container exposed so that it can be brought into direct thermal contact with the warming plate of a coffee maker, and further including thermal insulation material disposed in said sealed chamber between the cylindrical wall portion of said inner container and said cylindrical body portions of said jacket structure.

16. Insulated carafe comprising an inner container having a cylindrical wall portion with an outwardly inclined annular upper edge surface and a transverse base portion, jacket structure housing said inner container, said jacket structure including a first member having a cylindrical body portion surrounding and spaced from the cylindrical wall portion of said inner container, an annular, continuous flexible flange adjacent the top of said first member, said continuous flange exending over said upper edge surface of said inner container and said flange having an inner edge seated in positive sealing relation under elastic pretension on said outwardly inclined surface portion of said cylindrical wall portion and providing a first positive continuous seal all the way around said inner container, and coupling structure adjacent the bottom of said cylindrical body portion, a second member having a cylindrical body portion, an annular continuous flexible flange seated in positive sealing relation under elastic pretension on a lower portion of said inner container to provide a second positive continuous seal all the way around said inner container, and coupling structure in coupling engagement with the coupling structure of said first member, said first and second members having cooperating sealing surfaces adjacent said coupling structures in sealing engagement to provide a third continuous seal all the way around between said first and second members, said inner container and said jacket structure and said first, second and third continuous seals cooperating to provide a sealed chamber surrounding a cylindrical body portion of said inner container, and thermal insulation material disposed in said sealed chamber between said cylindrical body portion of said inner container and said cylindrical body portions of said jacket structure.

17. The carafe of claim 16 wherein said inner container is of single wall thickness glass, and said jacket structure is of plastics material.

18. The carafe of claim 16 wherein said cooperating coupling structures of said first and second jacket members are disposed on the sealed chamber side of said third seal.

19. The carafe of claim 16 wherein said annular flange of said second jacket member supports said transverse base portion of said inner container spaced above the bottom of said second jacket member with the middle part of the base of the inner container exposed so that it can be brought into direct thermal contact with the warming plate of a coffee maker.

20. The carafe of claim 19 wherein said inner container is of single wall thickness glass, said jacket structure is of plastics material, and said first member includes structure defining a pouring spout that extends radially outwardly from a point above said annular flange of said first member and structure defining a handle on the side of said first member generally opposite said pouring spout structure.

* * * * *